United States Patent [19]

Behne

[11] 4,328,896

[45] May 11, 1982

[54] WRAPPING MATERIAL AND METHOD OF FORMING WRAPPED PACKAGE

[75] Inventor: Jurgen Behne, Wolfersdorf, Fed. Rep. of Germany

[73] Assignee: Avon Products, Inc., New York, N.Y.

[21] Appl. No.: 216,789

[22] Filed: Dec. 16, 1980

Related U.S. Application Data

[60] Continuation of Ser. No. 957,671, Nov. 6, 1978, abandoned, which is a division of Ser. No. 852,052, Nov. 16, 1977, abandoned.

[30] Foreign Application Priority Data

Nov. 25, 1976 [DE] Fed. Rep. of Germany ..... 2653589
Nov. 25, 1976 [DE] Fed. Rep. of Germany ... 7637048[U]

[51] Int. Cl.[3] ..... B65D 75/38; B65D 85/16; B65D 65/00

[52] U.S. Cl. ..... 206/497; 206/45.33; 229/DIG. 12; 53/441

[58] Field of Search ..... 206/497, 45.31, 45.33, 206/45.34, 432, 583; 229/87 F, 87 B, 87 R, DIG. 12; 53/441

[56] References Cited

U.S. PATENT DOCUMENTS

| | | | |
|---|---|---|---|
| 2,333,943 | 11/1943 | Levkoff | 229/87 F |
| 2,412,370 | 12/1946 | Tascher et al. | 53/393 |
| 2,483,063 | 9/1949 | Ray | 493/137 |
| 2,956,672 | 10/1960 | Kirkpatrick | 206/497 |
| 2,980,245 | 4/1961 | Stoker, Jr. | 229/DIG. 12 |
| 2,987,402 | 6/1961 | Dold | 206/45.31 |
| 3,161,288 | 12/1964 | Wagner | 206/45.31 |
| 3,246,744 | 4/1966 | Marnon | 206/386 |
| 3,322,263 | 5/1967 | Gulliver | 206/497 |
| 3,334,734 | 8/1967 | Meyers | 206/45.31 |
| 3,442,372 | 5/1969 | Carmichael et al. | 206/497 |
| 3,581,460 | 6/1971 | Lambsdorff | 53/526 |
| 3,669,337 | 6/1972 | Struble | 220/461 |

FOREIGN PATENT DOCUMENTS

| | | | |
|---|---|---|---|
| 660809 | 9/1963 | Canada | 229/87 B |
| 691904 | 4/1964 | Canada | 206/497 |
| 2217186 | 2/1975 | Fed. Rep. of Germany . | |
| 2447940 | 4/1975 | Fed. Rep. of Germany . | |
| 1901104 | 9/1975 | Fed. Rep. of Germany . | |

*Primary Examiner*—William T. Dixson, Jr.
*Attorney, Agent, or Firm*—Pennie & Edmonds

[57] ABSTRACT

A wrappable material for wrapping products comprising means having marginal edge portions; and at least first and second bondable and heat shrinkable means, each being foldably connected to opposed marginal edge portions, and each one being foldable over the other in overlapping relationship. The opposed first and second bondable and heat shrinkable means comprises monoaxially shrinkable plastic material which is shrinkable in a direction generally transverse to the direction of the opposed edge portions. Also disclosed is a wrapped package for storing a quantity of materials comprising means having a bottom portion which receives thereon the material which is wrapped and has marginal edge portions; and having at least a pair of flap means, each one being foldably connected at one end to corresponding opposed marginal edge portions. Each of the flaps having free end portions in an overlapped relationship with the other so as to enclose the wrapped material. The overlapped end portions are bonded together, and the material of the flap means being heat shrunk onto the material wrapped. The method comprises steps of placing material to be wrapped onto a bottom portion of first means having opposed and foldable end portions and heat shrinkable foil flaps connected to opposed marginal edge portions of the bottom portion, folding the free end portions of the flaps over the material to be wrapped, in an overlapping manner, bonding the overlapped free end portions to one another, thereafter, heating the surface of the shrinkable flaps to cause shrinkage thereof, and closing the foldable end portions of the reinforced material over the heat shrunk flaps.

12 Claims, 10 Drawing Figures

WRAPPING MATERIAL AND METHOD OF FORMING WRAPPED PACKAGE

REFERENCE TO RELATED APPLICATIONS

This application is a continuation of application Ser. No. 957,671, filed Nov. 6, 1978, abandoned which, in turn, was a division of application Ser. No. 852,052, filed Nov. 16, 1977, now abandoned.

BACKGROUND OF THE INVENTION

A. Field of the Invention

The present invention relates to a wrapping material for a quantity of piece goods, which material includes shrinkable plastic foils and a reinforced generally flat material. The invention also pertains to a method of forming a wrapped package, as well as the wrapped package itself.

B. Background of the Invention

Whenever a quantity of medium-sized to small piece goods, for example, cosmetic articles, are to be assembled and wrapped to form a consignment lot, there is the problem of finding a wrapping material by which the quantity of goods can be uniformly and tightly wrapped since each of the cosmetic articles generally differ from one another.

One known attempt has been with foldable cardboard boxes of a size and dimension, such that the usual quantity of consignment lot would fit therein. In case of smaller consignment quantities, however, the remaining space of the cardboard box is filled by a suitable filling material so as to keep the goods in position within the box, notwithstanding the box being turned over. Wood fiber, filling paper, pourable polystyrol, or two-component foams have been considered suitable filling materials. Drawbacks are associated with such materials. In case of wood fiber, there is the danger of fire. Moreover, wood fiber is comparatively heavy and causes dust and undue work. Also, it is sensitive to dampness. Comparatively high costs and undue work are drawbacks which must be taken into account in connection with filling paper. Besides these drawbacks, it provides less than entirely sufficient protection for the packaged articles. Although little work is caused by pourable polystyrol, the price thereof is relatively high. The same disadvantage applies with respect to the two-component or supporting foam. Furthermore, all of these filling materials have one common drawback, that is, they have to be removed from the box and disposed of as waste. Furthermore, the amount of waste may be comparatively voluminous.

Soft and, preferably, transparent shrinkable foils have been known recently to be used in the wrapping technique. Some of such foils are also shrinkable monoxially, that is, they shrink in one direction only. It has also been known to deposit the articles to be wrapped on a rigid carrier sheet, and to enclose such articles and carrier sheet by means of a shrinkable foil and to fix the articles on the carrier sheet by shrinkage of the foil. A packing unit having the above features has been generally described in German application DE B No. 22 17 186. In such a unit, an article to be packed is positioned on a rigid carrier sheet and a carrier sheet. The foil sheet, sealed to opposite side portions of the carrier sheet, is shrunk onto the article. The opposite side portions of the carrier sheet sealed to the foil are folded over into juxtaposition with the side of the carrier sheet remote from the article. This unit may then be used as an insert in a container, e.g. a cardboard box, to be dispatched. Such packing unit, however, cannot easily be used for a quantity of loosely positioned piece goods. This approach, moreover, requires a lot of material since each additional piece of packing material must later be removed as waste. The reinforced carrier sheet is constructed as a folding sheet and the folded over side portions tend to return to the unfolded condition thereby to serve as springy cushions filling the space between the unit and the outer packing container.

SUMMARY OF THE INVENTION

The present invention seeks to overcome the disadvantages in the prior art by providing a wrapping of the type referred to above for wrapping a quantity of goods, such as medium-sized to small piece goods. Such wrapping can advantageously wrap different quantities of goods safely, hygienically, and attractively so that they can be packed in cardboard boxes or even assembled to units which can be stacked without the use of conventional filling material or carrier inserts. Such invention also provides an improved wrapped package as well as method of producing the same.

Briefly, in accordance with the invention, ther is a wrappable material for wrapping products comprising carrier means having marginal edge portions; and at least a bondable and heat shrinkable foil sheet foldably connected to opposed marginal edge portions. The foil sheet has a pair of ends which are foldable one over the other in overlapping relationship. The bondable and heat shrinkable foil sheet comprises monoaxially shrinkable plastic material which is shrinkable in a direction generally transverse to the direction of the opposed edge portions.

In one embodiment of the invention, the carrier means defining the marginal edge is defined by a reinforced generally flat material comprising an elongated rectangular cardboard portion having groups of folding lines. The groups of folding lines are spaced apart so as to define a bottom portion and extend transversely between the longitudinal side edges of the cardboard. The shrinkable foil sheet is defined either by one or a pair of foil sheets disposed between the two groups of folding lines. The shrinkable foil sheet is secured within the region of the marginal edges. The extending free end or ends of the shrinkable foil sheet, then, are adapted to be folded over the quantity of piece goods and the overlapped free ends are heat welded together in an overlapping relationship. The foil sheet is heat shrunk onto the piece goods. Parallel to each of said first mentioned folding lines at least one further folding line is provided. The end portions of the cardboard beyond the folding lines are folded over the quantity of piece goods held by the heat shrunk foil sheet.

A wrapped package of the present invention includes supporting carrier having marginal edge portions and a heat shrinkable and foldable foil sheet secured in the vicinity of and generally parallel to opposite edge portions of the supporting carrier. The foldable foil sheet is folded over the quantity of piece goods to be wrapped in an overlapped fashion. The extending free ends of the foldable foil sheet are bonded together and the foil sheet is heat shrunk onto the piece goods. The folded and heat shrunk foil sheet is covered by foldable cover portions of the supporting carrier overlapping one another.

By virtue of these embodiments, different quantities of, for example, medium-sized to small piece goods may be packed to a stackable unit at a low cost of material, and may be fixed in a supporting carrier, such as a cardboard box without the use of filling material. The quantity of piece goods will, without the use of filling material or a packing unit, such as described in the aforementioned German application supported at the inner walls of the cardboard box, be safely held in said cardboard box even if the latter turns over. If the shrinkable foil sheet is of transparent nature, smaller articles can no longer get lost when unwrapping the goods. With the packing method previously employed, it could happen that smaller articles were erroneously seized and thrown away when removing the filling material.

The method comprises steps of placing piece goods to be wrapped onto a supporting surface of a carrier having opposed foldable end portions and at least a bondable and heat shrinkable foil sheet which provides ends extending from the carrier. The foil sheet is connected to opposed marginal edge portions of the supporting surface of the carrier. The method also comprises folding the free end portions over the piece goods to be wrapped, and bonding the overlapped free ends to one another. Additionally, the method comprises heating the surface of the shrinkable foil sheet to cause shrinkage thereof, and closing the foldable end portions of the carrier foil sheet over the heat shrunk flaps.

A method of filling and closing the packing in accordance with the present invention permits both rapid and cost reduced wrapping of different quantities of medium-sized to small piece goods in conveyor-line production. In an embodiment of the method, welding of the overlapped ends of the shrinkable foil sheet is carried out in such a manner that the packing including the piece goods are passed through an area of concentrated heat in the region of the ends, such as under one or several nozzles which emit a directed jet of hot air. The free ends of the welded shrinkable foil sheet are heated in accordance with the invention to a temperature in order to obtain shrinkage under a wide flow of hot air, under which the packing is moved. Accordingly, manual operations are not necessary in conveyor-line production for the welding and shrinkage processes. The filled package merely passes under the noted respective devices. Welding and shrinkage, i.e., the supply of heat, may, of course, be carried out in any other suitable way. Welding, for example by means of a welding device, moved over the overlapping region of the foils or by pressing and heating the edges of the foil flaps can be attained. Shrinkage for example, may be obtained by means of an infrared radiator to which the entire surface of the shrinkable foil sheet extending over the quantity of the piece goods, may be exposed.

In another method of packing a quantity of piece goods by means of a reinforced flat material made from an elongated rectangular cardboard portion, the reinforced flat material and shrinkable foil flaps fixed thereto are first inserted in a hollow template, in particular a basket. The templet supports the piece goods sufficiently through welding and shrinking of the flaps and up to closing the free narrow sides of the flat material while passing along the passage for wrapping. After removal of the closed wrapped package, the hollow template may be used for a new cycle of operation.

BRIEF DESCRIPTION OF THE DRAWINGS

Embodiments given as an example of the subject matter of the present invention will be described hereinafter with reference to the accompanying drawings, wherein.

DETAILED DESCRIPTION

Figure 1:
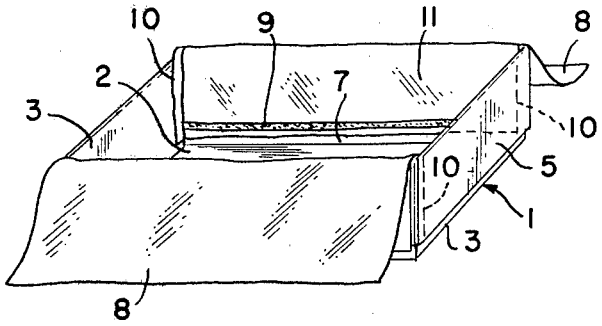
FIG. 1 shows a wrapping in accordance with the invention comprising a rectangular cardboard box in its open position.

In the wrapping in accordance with FIG. 1, the reinforced flat material comprises a generally erect rectangular folding cardboard box 1. The box 1 has a bottom portion 2 comprising supporting surface, an opposed pair of narrow side walls 3, an opposed pair of longitudinal side walls 4 and opposed pairs of cover flaps 5, 6. The cover flaps 5, 6 are illustrated in their open state in the vicinity of opposite bottom edges 7. Shrinkable foil sheets 8 are secured to the side walls 4. The foil sheets may be glued or welded along the side walls within a region 9, near the bottom edges for example. The shrinkable foil sheets 8 are wider than the length of said side walls 4, so that lateral protective flaps 10 are formed. The flaps 10, as apparent in FIG. 2, may be clamped in between the narrow sidewalls 3 and the piece goods to be filled in, as shown by arrow 11.

After a certain quantity of piece goods have been filled in and the distributed, as evenly as possible, within cardboard box 1, the shrinkable foil flaps 8 will be folded over the filled in piece goods with the free ends in overlapping relationship. The overlapped region is welded together as at 12. Shrinkage of the foil flaps 8 is subsequently carried out by means of heat influence. The heat may be applied from over the entire opening of the cardboard box 1, so that said piece goods (not shown) are fixedly secured in said cardboard box 1. Since the foil sheets 8 are comprised of monoaxial shrinkable foils, such shrinkage will occur in the direction of the narrow side walls 3 so that the piece goods will remain fully covered in the direction of the longitudinal side walls 4 even after the foil has shrunk.

Figure 3:
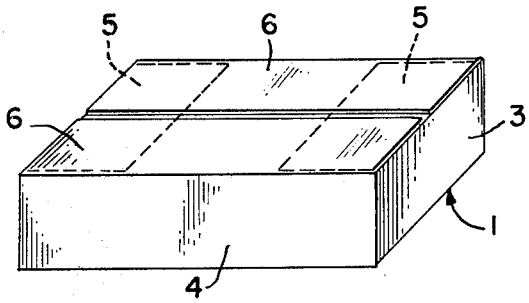
FIG. 3 shows the wrapping of FIGS. 1 and 2 in completely closed position.

As may be seen from FIG. 3, cover flaps 5 and 6 of cardboard box 1 are closed and the wrapping or package can be dispatched. It will be understood that the piece goods are safely and fixedly secured within the carboard box 1, even if the box is not fully filled by the quantity of piece goods, and without any filling material being necessary. Accordingly, for instance, even if cardboard box 1 is turned over, such goods will remain in their wrapped position.

Figure 4:
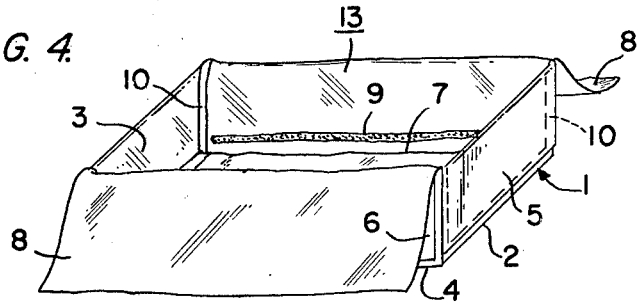
FIG. 4 shows a representation of another embodiment similar to FIG. 1.

In the embodiment shown in FIG. 4, identical parts have been provided with identical reference numerals, as FIG. 3. The foil sheets are, in this embodiment, merely formed by a continuous sheet which extends over bottom portion 2 of cardboard box 1. The foil sheet is connected to the longitudinal side walls 4 of the cardboard box in the manner of foil sheets 8. The connection between foil sheet 13 and cardboard box 1 can equally be obtained in the region of bottom 2; however, it is advisable to obtain such connection always in the region adjacent the bottom edges 7 as well.

Figure 5:
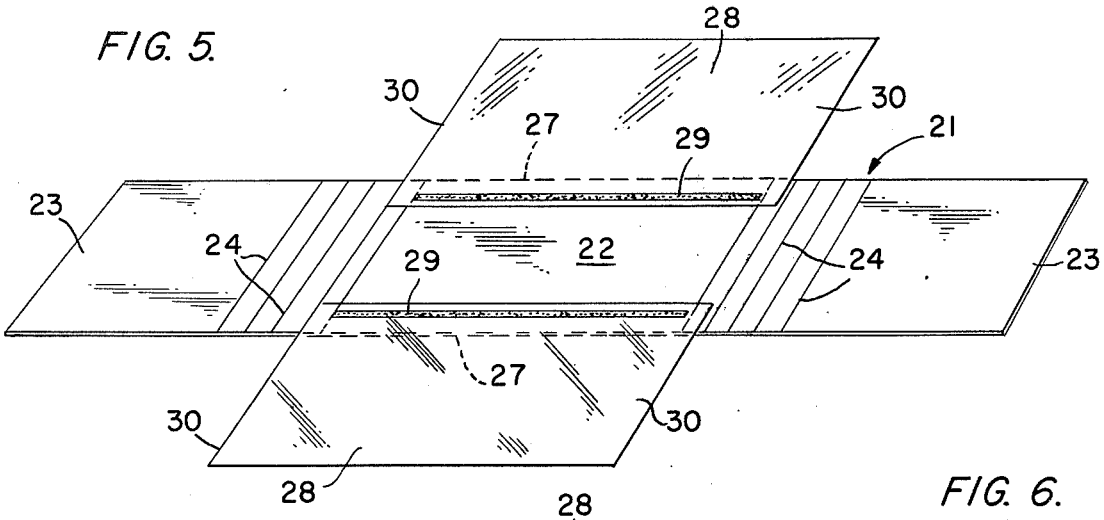
FIG. 5 shows a wrapping in accordance with the invention using an elongated rectangular cardboard portion as reinforcing flat material in an open position.
Figure 6:
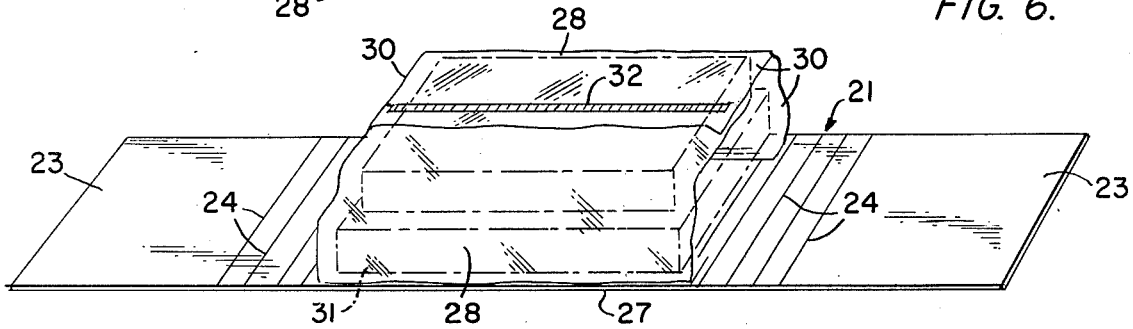
FIG. 6 shows the wrapping of FIG. 5 with foil being overlapped over the piece goods.
Figure 7:
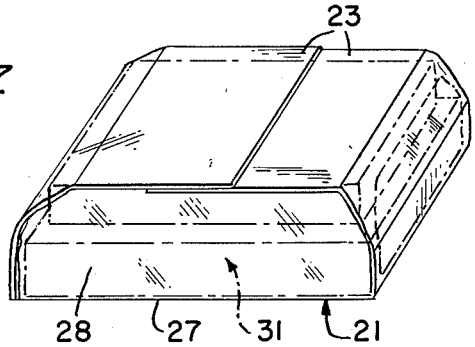
FIG. 7 shows a completely closed wrapping in accordance with FIGS. 5 and 6.
Figure 10:
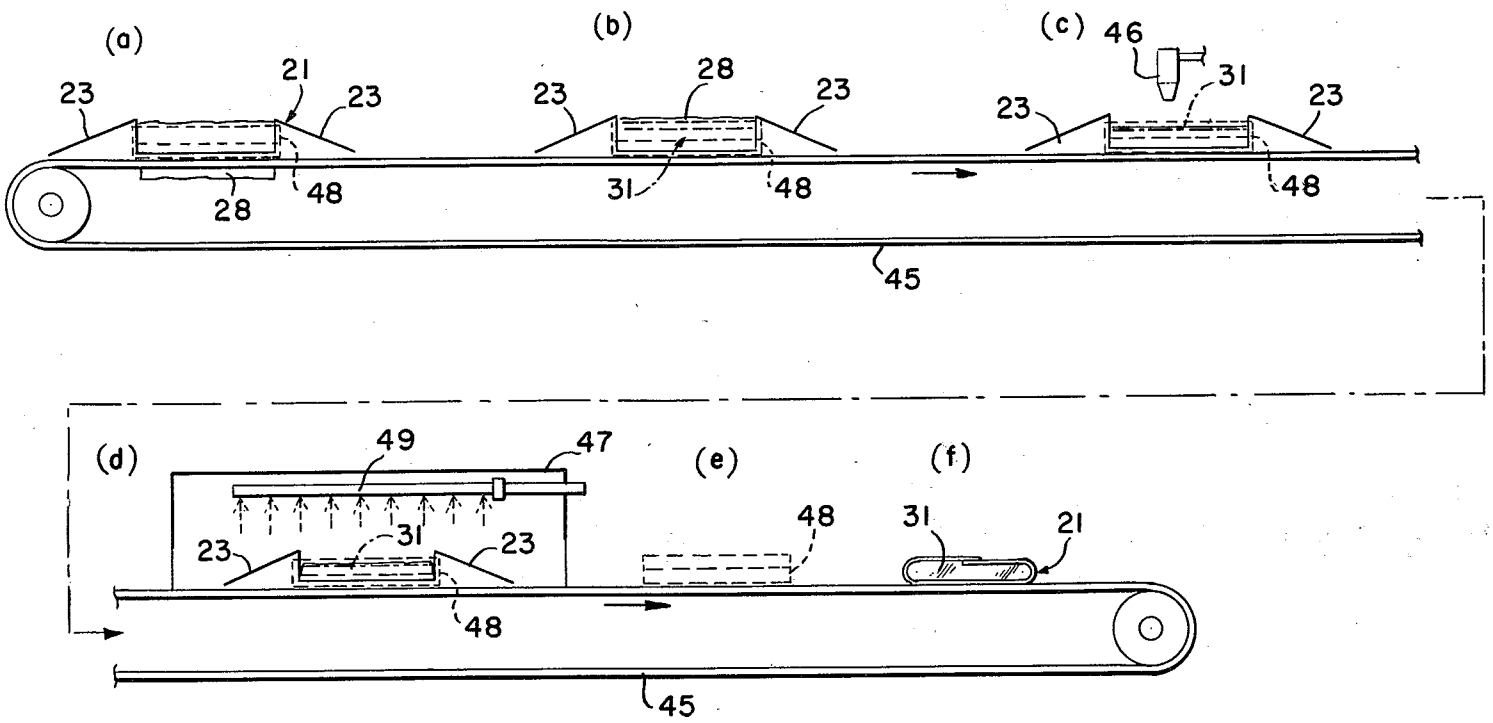
FIG. 10 shows schematically the steps of the method when using a wrapping in accordance with FIG. 5 to 8.

In the embodiment shown in FIGS. 5 to 8, the carrier comprises an elongated rectangular cardboard portion 21 of reinforcing flat material. The cardboard portion 21 is shown with a plurality of groups of parallel fold lines 24, 24 extending transverse to the long dimension of the carrier. Opposed groups of fold lines 24, such as depicted, define bottom portion 22, side flaps and cover flaps 23, respectively. Shrinkable foil sheets 28 are secured in the vicinity of side edges 27 of bottom portion 22. The foil sheets 28 are of a greater width than the length of the bottom portion 22 along the side edges 27. Thus, the sheets 28 form lateral protection flap areas 30. The foil sheets 28 are glued or welded to bottom portion 22, within a region therealong at 29. As may be seen from FIG. 6, the quantity of piece goods 31 to be wrapped is stacked on bottom portion 22. Piece goods 31 have been schematically shown by dotted blocks, but, in fact, they comprise a plurality of individual pieces, which are suitably held by a hollow template (not shown) prior to overlapping the foil sheets 28, as shown in FIG. 10. As best seen in FIG. 6, foil sheets 28 are folded together so that their free side edges are in an overlapping manner over the piece goods 31. The overlapped side edges are welded together at 32. Protective flaps 30 extend laterally beyond the quantity of piece goods 31 and are clamped between the stacked piece goods and the flaps including the side flaps and cover flaps 23 which are turned-up in the manner shown in FIG. 7. Turning up of the flaps and connecting or bonding the cover flaps 23 together to form the closed package will be carried out after the foil sheets 28 have been shrunk on the piece goods 31 by heat influence applied from above, as shown in their position in FIG. 6. Since monoaxial shrinking foils are used, the shrinkage is effected only in the direction parallel to the fold lines 24 or generally transversely to side edges 27. In this manner, piece goods 31 remain covered over their entire length by the foil after shrinkage.

Figure 8:
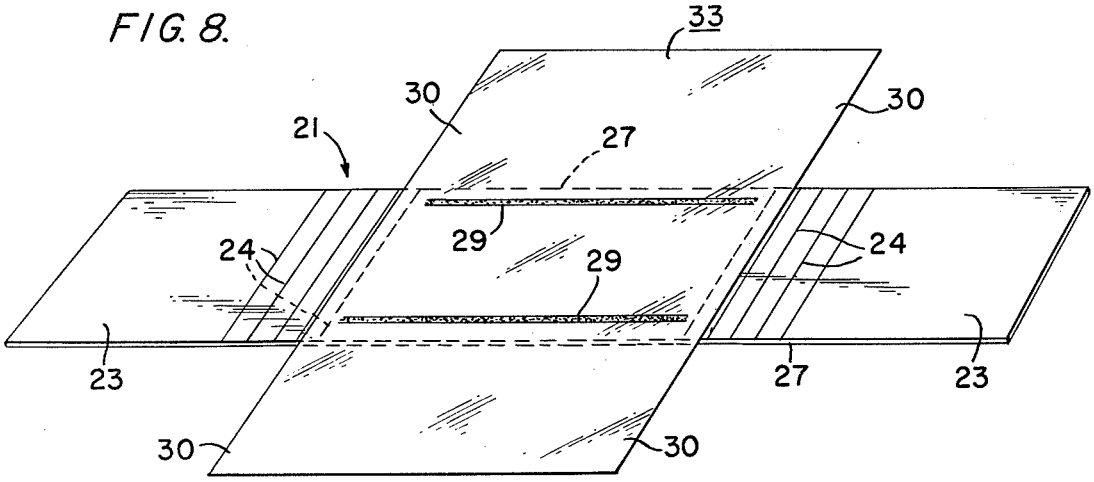
FIG. 8 shows the representation of a further embodiment according to the wrapping of FIG. 5.

In the embodiment of FIG. 8, parts identical to those parts in FIG. 5 have been provided with identical reference numerals. This embodiment differs from the embodiment of FIG. 5 in that the foil sheets 28 are formed from one single foil sheet 33 secured to bottom portion 22. The foil sheet 33 may be secured either to the top or bottom surface of the bottom portion 22 along region 29 adjacent the side edges 27 to extend outwardly of the generally rectangular cardboard portion 21.

Figure 2:
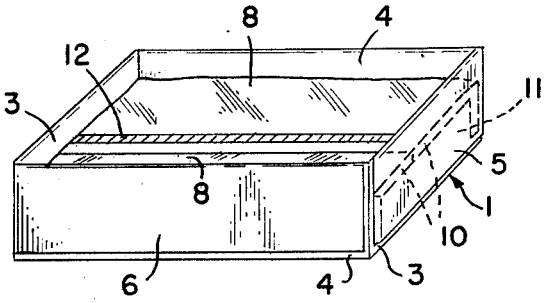
FIG. 2 shows the wrapping of FIG. 1 in a condition filled with piece goods after the shrinkable foil sheet has been overlapped and shrunk.
Figure 9:
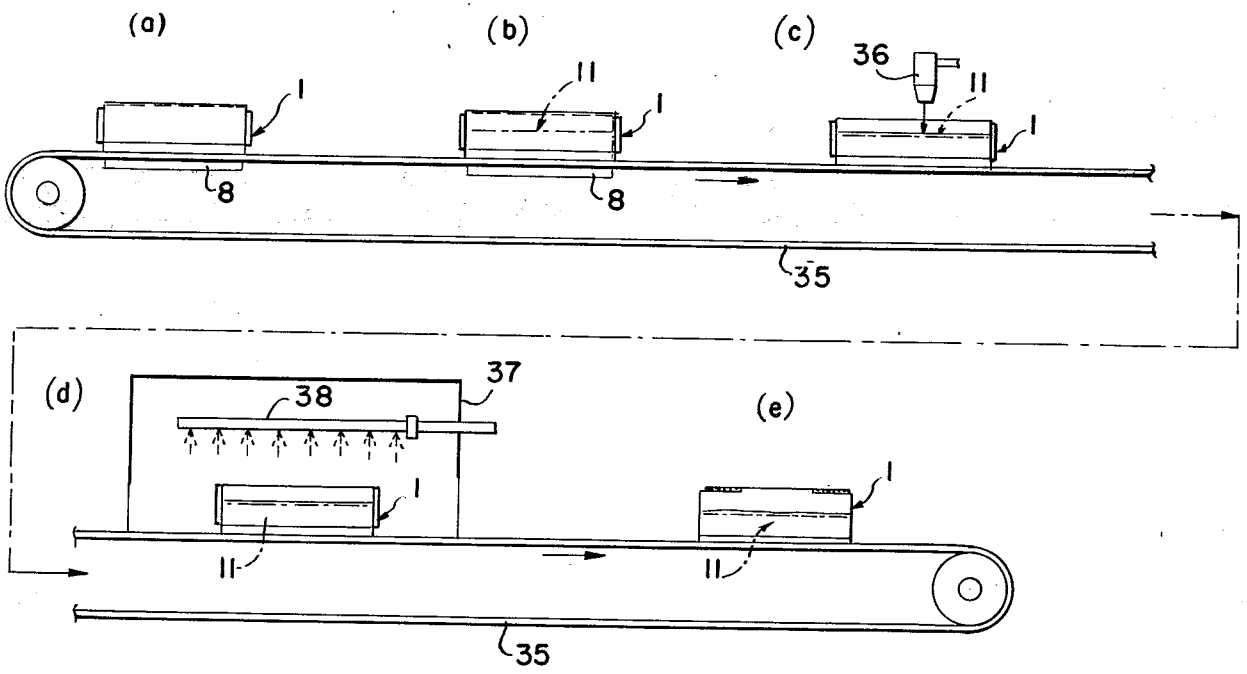
FIG. 9 shows schematically the steps of the method when using a wrapping in accordance with FIGS. 1 to 4.

In accordance with FIG. 9, wrapping of goods 11, shown by dotted lines, in a package in accordance with FIGS. 1 to 4 may be carried out by means of conveyor-line production. The open package of FIG. 1 is placed on the conveyor line 35 at position (a). Goods 11 are filled into the packing at position (b). Foil flaps 8 are subsequently folded, in an overlapping manner, over the quantity of goods 11 and are welded at position (c). A nozzle 36 located above the conveyor line 35 emits a jet of hot air of sufficient heat so that the foil sheets 8 will be welded as the package passes along line 35 under the nozzle 36 as shown in FIG. 2. It will be appreciated that one or more nozzles may be used. A tunnel oven shaped hood 37 is provided above the conveyor line 35 at station (d) within which a "hot air shower" 38 is provided so that the shrinkable foil sheets 8 will be shrunk onto the quantity of piece goods 31 contained in cardboard box 1. It is understood that the components and operation of such a shower are known in this particular art. After leaving the tunnel 37 the wrapping is closed at position (e). This is accomplished by closing the side flaps and cover flaps 23. Consequently, the package is ready to be dispatched.

FIG. 10 schematically shows the package process for a package of the type shown in FIGS. 5 to 8 being transported on a conveyor 45. The rectangular cardboard portion 21 with shrinkable foil sheets 28 is first inserted in a basket 48. The basket 48 serves as hollow template as at position (a). The rectangular cardboard portion is received in the hollow template in a manner such that the side flaps extend upwardly and the cover flaps extend outwardly of the template to provide a cavity into which piece goods 31 are received. After filling the cavity with the quantity of piece goods 31, the foil sheets 28 are overlapped at position (b), and the basket 48 is passed along conveyor 45 to, position (c) beneath one or more nozzles 46. Each nozzle 46 emits a jet of hot air so that the foil sheets 28 are welded along a line, such as line 32 in FIG. 6. A tunnel oven shaped hood 47 is provided at position (d) within which is provided a conventional hot air shower 49 so that the shrinkable foil sheets are shrunk onto the quantity of piece goods 31. The hot air shower 49 may be replaced by an infrared heating device, for example. After leaving the hood 47 at position (e), the packing will be removed from the basket 48 by means of cover flaps 23 of the rectangular cardboard portion 21. In this fashion, the basket 48 will be free for the next cycle of operation. The wrapping is rendered ready for dispatch at position (f) by folding cover flaps 23 and connecting same by, for example, gluing. This embodiment of the package will be suitably stacked in an erect position. The cardboard portion 21 provided with fold lines 24 and being positioned on the top and on the bottom serve as cushions for purposes of reducing the danger of bulging.

It will be appreciated that the present invention provides an improved wrapping material that can form a unique wrapped package for safely, hygienically, attractively, reliably, and economically wrapping a plurality of articles. The novel steps of the wrapping process are also self-evident from the above description.

By virtue of the aforementioned description, the significant features of the present invention become readily apparent.

While the invention has been described in connection with the preferred embodiments, it is not intended to limit the invention to the particular forms set forth above, but, on the contrary, it is intended to cover such alternatives, modifications, and equivalents as may be included within the spirit and scope of the invention as defined by the appended claims.

What is claimed is:

1. The combination of a carton or packing piece goods, said carton having a surface for supporting a plurality of said piece goods and opposed pairs of spaced, substantially parallel walls defining a space of predetermined size within which said piece goods are substantially confined; foldable, heat shrinkable material in the form of at least a foil sheet connected to said carton along a region adjacent each junction between said supporting surface and a wall of one pair of opposed sidewalls, said foil sheet having portions which extend toward a free and remote from said regions; and an indeterminate plurality of piece goods of varying size at least to partially fill said space, said extending portions of said foil sheet are folded in overlapped relation about said piece goods, bonded together along the overlapped length and heat shrunk on to said piece goods thereby to force said piece goods individually toward said supporting surface and physically locate each of said piece goods within said space irrespective of the number of piece goods packed and the amount of space which is filled.

2. The combination of claim 1 wherein one pair of sidewalls is of a length longer than said other pair of sidewalls, and wherein said regions are adjacent the longer junctions.

3. The combination of claim 2 wherein said foil sheet is of a width in excess of the length of said region whereby said foil sheet is shrunk about the sides of at least some of said piece goods.

4. The combination of any one of claims 1, 2 or 3 wherein said foldable, heat shrinkable material comprises a pair of foil sheets, and wherein one foil sheet is connected along one region and the other foil sheet is connected along the other region.

5. The combination of claim 1 wherein each said region is disposed along said walls of said pair of opposed sidewalls.

6. The combination of claim 1 wherein the shrinkage axis of said foldable, heat shrinkable material is substantially transverse to a plane including each said junction.

7. The combination of claim 1 including means for completely enclosing said space and the piece goods packed therein.

8. The combination of claim 7 wherein said means for completely enclosing said space includes at least one cover flap extending from a wall partially defining said space and adapted to be folded to a plane substantially parallel to said supporting surface.

9. The combination of claim 8 including a plurality of cover flaps each extending from a wall defining said space and adapted to be folded to a plane substantially parallel to said supporting surface.

10. The combination of a carton for packing piece goods, said carton having a surface for supporting a plurality of said piece goods, opposed pairs of spaced, substantially parallel walls defining a space of predetermined size and a cover flap extending from at least one wall foldable to plane substantially parallel to said supporting surface to enclose said space; foldable, heat shrinkable material in the form of at least a foil sheet connected to said carton along a region adjacent each junction between said supporting surface and a wall of one pair of opposed sidewalls, said foil sheet having portions which extend toward a free end remote from said regions; and an indeterminate plurality of piece goods of varying size at least to partially fill said space, said extending portions of said foil sheet are folded in overlapped relation about said piece goods, bonded together along the overlapped length and heat shrunk onto said piece goods thereby to force said piece goods individually toward said supporting surface and physically locate each of said piece goods within said space irrespective of the number of piece goods packed and the amount of said space which is filled.

11. The method of wrapping piece goods of possible varying size and comprising an indeterminate plurality in a stack on a surface of a carton having opposed pairs of spaced, substantially parallel walls defining a space of predetermined size within which said piece goods are partially enclosed, folding sequentially each portion of a heat shrinkable material in the form of at least a foil sheet which shall extend from a region adjacent each junction between said surface and a wall of one pair of opposed sidewalls over and in juxtaposition to at least a portion of said piece goods uppermost in said stack so that said extending portions overlap, bonding the overlapped extending portions of said material, heating the extending portions of said material whereby said foil sheet shrinks about said stack of piece goods in securement of the same irrespective of the number of piece goods stacked and the space which is filled, and, finally, closing said carton.

12. The method of claim 11 wherein said step of heating the extending portion of said material is carried out by passing the bonded overlapped extending portions under a wide flow of hot air at a predetermined temperature to achieve shrinkage.

* * * * *

UNITED STATES PATENT AND TRADEMARK OFFICE

CERTIFICATE OF CORRECTION

PATENT NO. : 4,328,896

DATED : May 11, 1982

INVENTOR(S) : Jurgen Behne

It is certified that error appears in the above-identified patent and that said Letters Patent are hereby corrected as shown below:

Column 2, line 24, "ther" should be --there--;

Column 3, line 27, after "carrier" cancel "foil sheet";

line 27, after "shrunk" cancel "flaps" and insert --foil sheet--;

Column 6, line 63, "or" should be --for--;

Column 7, line 5, "and" (first occurrence) should be --end--.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*